US012285101B2

(12) United States Patent
Trollope

(10) Patent No.: US 12,285,101 B2
(45) Date of Patent: Apr. 29, 2025

(54) FOLDABLE STACKING STORAGE CABINET

(71) Applicant: Laila Trollope, New River, AZ (US)

(72) Inventor: Laila Trollope, New River, AZ (US)

( * ) Notice: Subject to any disclaimer, the term of this patent is extended or adjusted under 35 U.S.C. 154(b) by 2 days.

(21) Appl. No.: 18/119,571

(22) Filed: Mar. 9, 2023

(65) Prior Publication Data

US 2024/0298791 A1 Sep. 12, 2024

(51) Int. Cl.

| | |
|---|---|
| ***B65D 6/18*** | (2006.01) |
| ***A47B 43/00*** | (2006.01) |
| ***A47B 87/02*** | (2006.01) |
| ***B65D 21/02*** | (2006.01) |
| ***B65D 88/52*** | (2006.01) |
| *B65D 6/16* | (2006.01) |
| *B65D 25/00* | (2006.01) |

(52) U.S. Cl.

CPC ..... *A47B 43/00* (2013.01); *A47B 87/0276* (2013.01); *B65D 11/1826* (2013.01); *B65D 11/1833* (2013.01); *B65D 11/184* (2013.01); *B65D 88/522* (2013.01); *B65D 11/18* (2013.01); *B65D 25/005* (2013.01)

(58) Field of Classification Search

CPC . A47B 43/00; A47B 87/0276; A47B 87/0253; A47B 87/0207; B65D 11/1826; B65D 11/1833; B65D 11/184; B65D 21/0217; B65D 21/0223; B65D 11/18; B65D 21/023; B65D 88/522

See application file for complete search history.

(56) References Cited

U.S. PATENT DOCUMENTS

| | | | | |
|---|---|---|---|---|
| 6,578,937 | B1 * | 6/2003 | Thoman | B25H 3/028 312/902 |
| 7,431,172 | B1 * | 10/2008 | Spindel | B65D 11/1853 217/15 |
| 7,510,097 | B2 * | 3/2009 | Spindel | B65D 11/1826 220/651 |
| 11,711,047 | B2 * | 7/2023 | Wickramasekera | E04B 1/34363 52/79.5 |
| 2003/0052158 | A1 * | 3/2003 | Spindel | B65D 11/1853 220/4.28 |
| 2003/0146213 | A1 * | 8/2003 | Kellerer | B65D 11/22 220/7 |
| 2004/0149753 | A1 * | 8/2004 | Schafer | B65D 11/26 220/6 |
| 2010/0025397 | A1 * | 2/2010 | Krohn | B65D 88/522 220/6 |
| 2015/0041420 | A1 * | 2/2015 | Zelek | A47F 5/10 211/195 |
| 2016/0368656 | A1 * | 12/2016 | Green | B65D 11/1826 |

(Continued)

FOREIGN PATENT DOCUMENTS

CN 203776407 U * 8/2014

*Primary Examiner* — Kimberley S Wright

(57) ABSTRACT

The Foldable Storage Cabinet is the only product of its kind that offers a versatile cabinet that can be stacked upright for housing supplies, materials, etc. and then post-need, can be collapsed and effectively stored away, saving space. This unprecedented product is uniquely designed with durable latches, hinges, and a sliding track to ensure long-term functionality and the Foldable Storage Cabinet comes in a wide variety of sizes and colors to cater to specific user preferences in order to complement their homes, salons, garages, offices, and a host of other purposeful locations.

20 Claims, 3 Drawing Sheets

(56) References Cited

U.S. PATENT DOCUMENTS

| | | | | |
|---|---|---|---|---|
| 2019/0328159 | A1* | 10/2019 | Marivoet | A47B 87/0207 |
| 2022/0281639 | A1* | 9/2022 | Ismert | B65D 11/1873 |
| 2022/0289426 | A1* | 9/2022 | Green | B65D 11/18 |
| 2023/0380588 | A1* | 11/2023 | Lv | A47B 87/02 |
| 2024/0067394 | A1* | 2/2024 | Elvin-Jensen | B65D 55/02 |

* cited by examiner

FOLDABLE STACKING STORAGE CABINET

BACKGROUND

A streamlined home is always the goal, but taming clutter when there's a limited space available can be incredibly tricky especially if a person is adamant about organization. For those living in a studio or a small one bedroom home space storage is a common concern, however, there are moments when storage is a short-term requirement; yet, discarding furniture is not suitable when it may be of use at a later date. There have been no products available as original equipment or as an aftermarket to address this problem.

An apparatus to help streamline your home's organization in an effective, space efficient manner, is not being met by any known device or system at present. There have been no products available as original equipment or as an aftermarket to address this problem either.

SUMMARY OF THE INVENTION

The main purpose of the foldable stacking storage cabinet is to provide users with a collapsible cabinet that allows one to store clutter and organize small spaces, when needed, while having the luxury to store the cabinet unit away when it's not being utilized.

A storage cabinet is claimed comprising a tray including a flat base, a raised rim on two lateral sides and an open front side, a flat lid configured for the tray and comprising two lateral sides, a back side and a front side, a pair of walls hinged at the respective raised rim and comprising a plurality of recessed sliding tracks extending in a direction of the raised rim and configured to collapse like a drawbridge, and a slider arm configured to slide within one of the plurality of recessed sliding tracks on a first end and hingedly attach to a lateral side of the flat lid on a second end.

Figure 1:
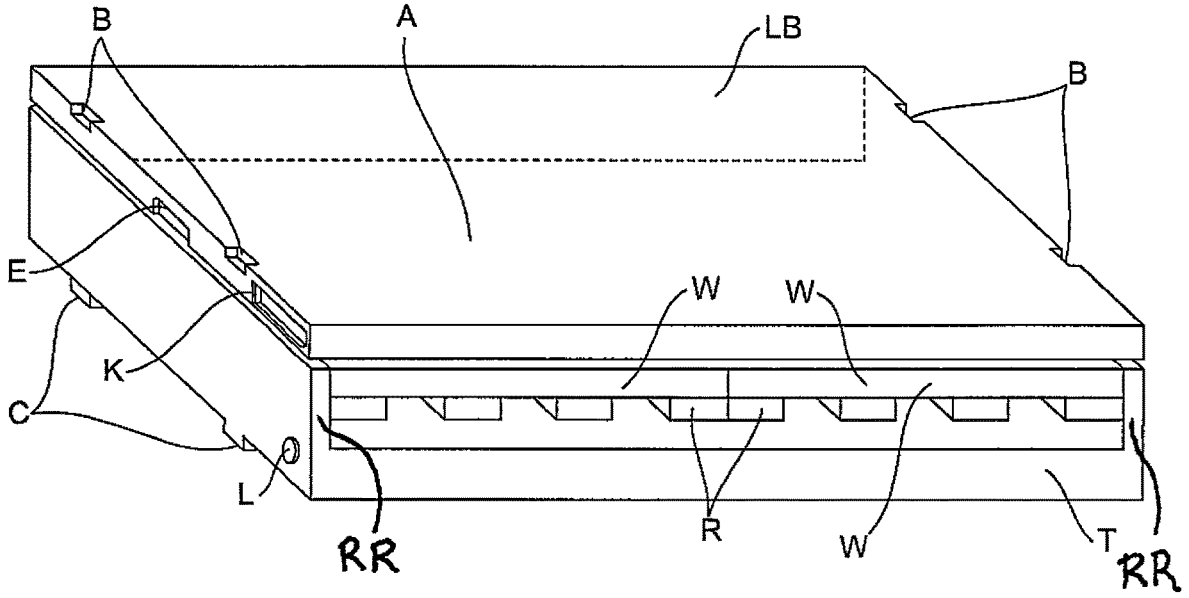
FIG. 1 is a perspective view of a single folded storage cabinet in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a perspective view of a single folded storage cabinet showing: collapsible shelf unit with rear holes to mount on walls referenced as A, recessed notches referenced as B, fixed tabs referenced as C, side handles referenced as E, door retracting knob referenced as K, spring release button referenced as L, in accordance with an embodiment of the present disclosure. The shelf runners R, the pair of walls W and the tray T are joined at the raised rims RR as depicted. The spring release latches and unlatches the walls W into orthogonal relation with the tray T and the top of the storage cabinet. The lid includes a raised backside LB (depicted in broken lines) complementary to the raised sides of the tray T and defines holes for a mounting of the storage cabinet onto a wall of a structure in embodiments.

Figure 2:
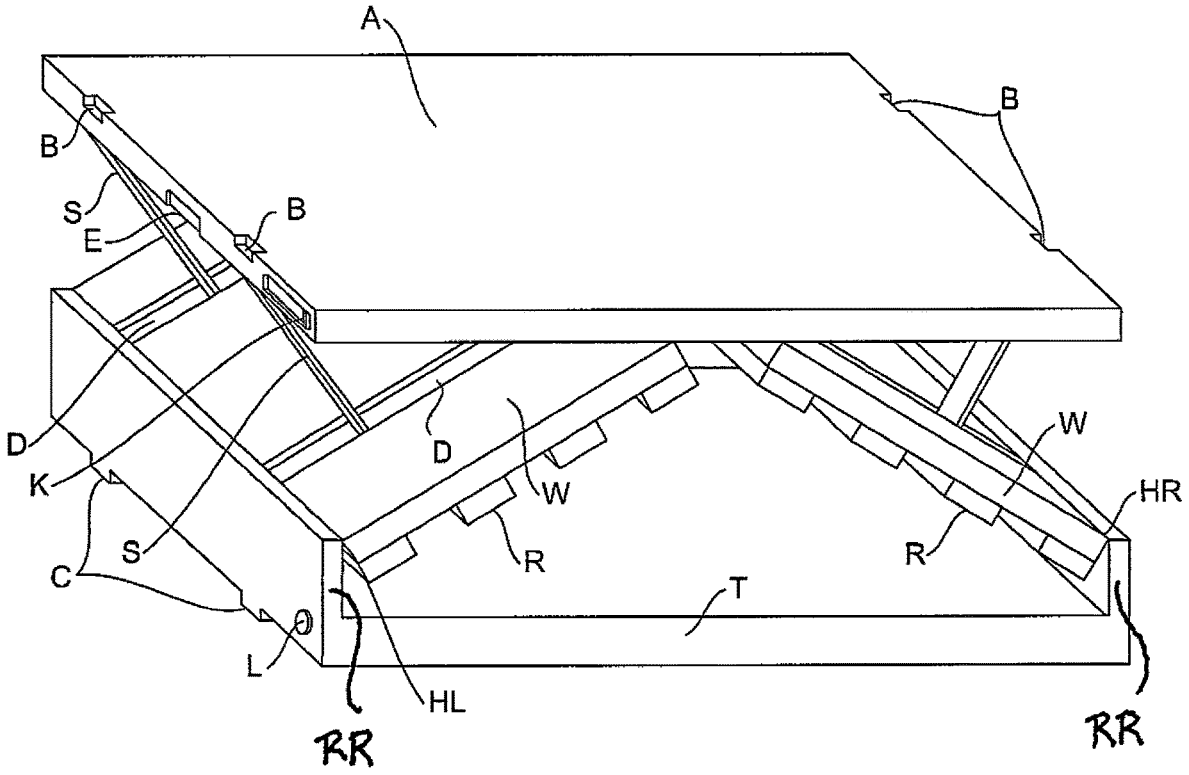
FIG. 2 is a perspective view of a single unfolding storage cabinet in accordance with an embodiment of the present disclosure.

FIG. 2 is a perspective view of a single unfolding storage cabinet showing: collapsible shelf unit with rear holes to mount on walls referenced as A, recessed notches referenced as B, fixed tabs referenced as C, sliding track referenced as D, side handles referenced as E, door retracting knob referenced as K, spring release button referenced as L, in accordance with an embodiment of the present disclosure. The shelf runners R, the walls W and the tray T are hinged at the raised rims RR as depicted. Additionally, the sliding tracks D, the sliders S and the hinges HL and HR are also shown. The sliding tracks are recessed into the walls W like grooves up and down a full height of the walls W. The slider arms S are hinged adjacent a top side of a storage cabinet on a first end and freely run along a respective sliding track on a second end thereof to cantilever the walls during unfolding. The pair of walls W are therefore cantilevered from the slider arms S like a drawbridge into the tray for flat storage.

Figure 3:
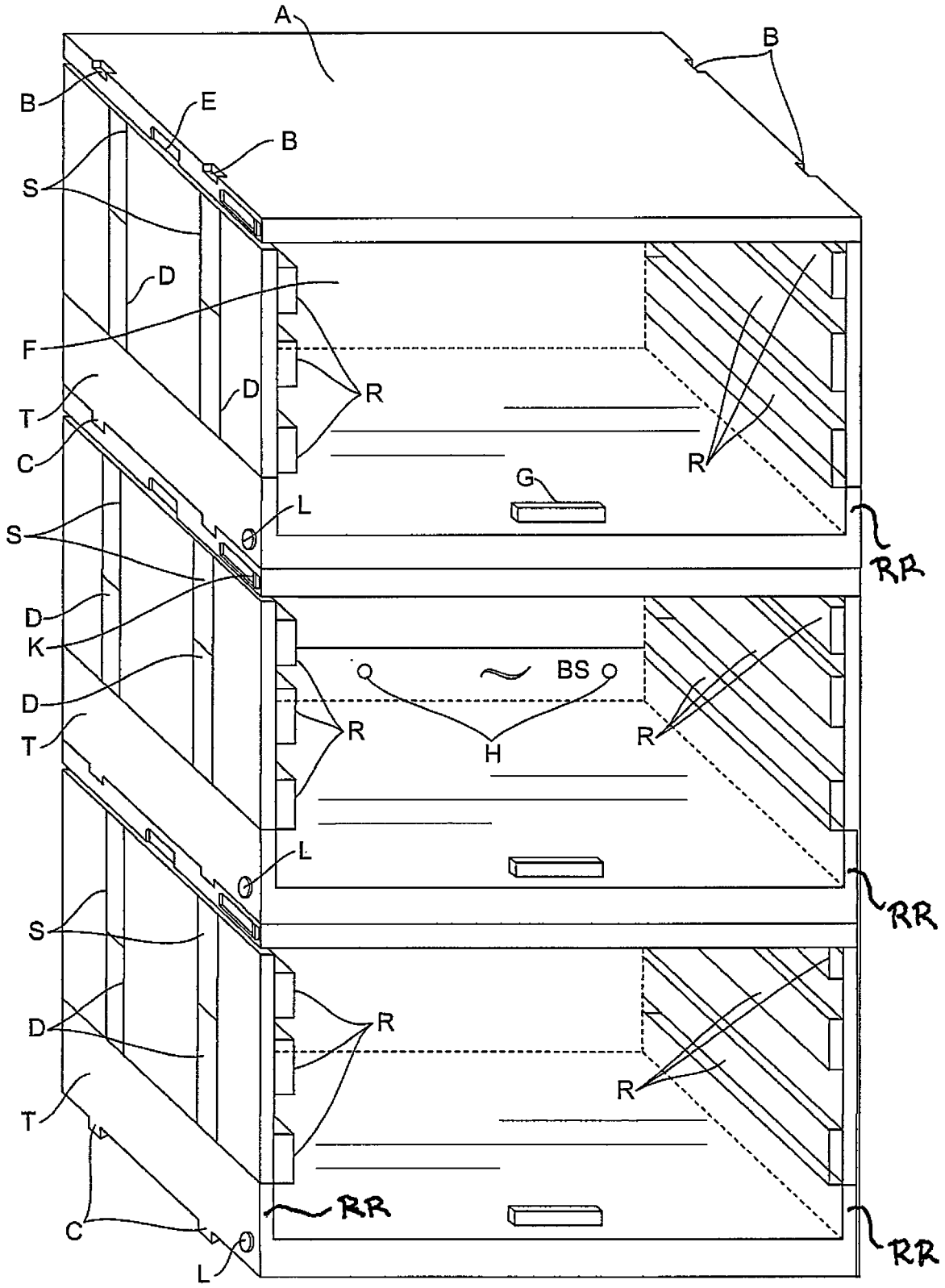
FIG. 3 is a perspective view of three stacked and fully unfolded storage cabinets in accordance with an embodiment of the present disclosure.

FIG. 3 is a perspective view of three stacked and fully unfolded storage cabinets showing: collapsible shelf unit with rear holes to mount on walls referenced as A, recessed grooves referenced as B, fixed tabs referenced as C, side handles referenced as E, gray tinted see-thru plastic retractable door referenced as F, door handle referenced as G, door retracting knob referenced as K, spring release button referenced as L, in accordance with an embodiment of the present disclosure. The unfolded storage cabinets A are locked into place on top of each other via the complementary recessed notches and the fixed tabs. The sliders S remain inside the sliding tracks and are approximately have a height of a respective sliding track in order to cantilever a respective wall hinged at the bottom tray T at the raised rims RR. The backside BS of the tray is raised and defines holes H for a mounting of the storage cabinet onto a wall of a structure such as a kitchen wall, a bathroom wall, etc. Alternatively, the lid includes a raised backside LB (depicted in FIG. 1) complementary to the raised sides of the tray T and defines holes for a mounting of the storage cabinet onto a wall of a structure.

The present disclosed Foldable Storage Cabinet, offers a modern accessory that provides a primary unit able to cleverly conceal excess clutter when used while also permitting the person to deconstruct the unit into a compact item allowing them to store it away, at their preference. Expanding on the initial design of a cabinet, the Foldable Storage Cabinet introduces a novel collapsible shelf unit possessing retractable doors whereas users can stack the shelves on top of each other enabling them to store more items while utilizing less space and when the foldable storage cabinet is not in use, one would simply collapse the unit, akin to an accordion folding approach, and then store it without consuming a vast amount of space in comparison to a typical piece of furniture. Moreover, this avant-garde product can easily be moved from one location to another, making it easily accessible and useful in a wide variety of settings, indoors or outdoors, and for varying occasions. This innovative, top-quality product provides flexibility on how storage spaces can be utilized and helps eliminate overcrowding a home with 'stuff'.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A storage cabinet comprising:

a tray comprising a flat base, a raised rim on two lateral sides and an open front side;

a flat lid configured for the tray and comprising two lateral sides, a middle between the two lateral sides, a back side and a front side;

a pair of walls hingedly cantilevered at the respective raised rim and comprising a plurality of recessed sliding tracks extending in a direction of the raised rim and configured to collapse like a drawbridge under the middle of the flat lid; and a slider arm configured to slide within one of the plurality of recessed sliding tracks on a first end and hingedly attach to a lateral side of the flat lid on a second end.

2. The storage cabinet of claim 1, further comprising a raised rim on a back side of the tray.

3. The storage cabinet of claim 1, further comprising a spring release configured to latch the walls into an orthogonal position relative to the flat base.

4. The storage cabinet of claim 1, wherein the tray further comprises a plurality of fixed tabs on the two lateral sides adjacent the flat base.

5. The storage cabinet of claim 4, further comprising a plurality of recessed notches on the lid lateral sides complementary to a plurality of fixed tabs.

6. The storage cabinet of claim 1, further comprising a gray tinted see through plastic retractable door hingedly connected to the lid front side.

7. The storage cabinet of claim 6, wherein the retractable door retracts parallel with the lid for a collapse of the pair of walls also parallel to the lid.

8. The storage cabinet of claim 1, further comprising a plurality of shelf runners disposed on an inside of the pair of walls and extending parallel to the two lateral sides.

9. The storage cabinet of claim 1, wherein a number of the plurality of recessed sliding tracks is two per each one of the pair of walls.

10. The storage cabinet of claim 1, further comprising a removable back wall connected to one of the lid and the lateral sides.

11. The storage cabinet of claim 1, wherein a height of the raised rim is greater than a thickness of one of the pair of walls.

12. The storage cabinet of claim 10, wherein a height of the raised rim is greater than the thickness of one of the pair of walls plus a thickness of a shelf runner on an inside of each one of the pair of walls.

13. The storage cabinet of claim 1, wherein a thickness of the lid collapsed ontop of the tray is equal to a thickness of the lid plus a height of the raised rim.

14. The storage cabinet of claim 1, further comprising a back wall configured to retract parallel with the lid for a collapse with the pair of walls also parallel to the lid.

15. The storage cabinet of claim 1, further comprising a raised rim on a backside of the tray and defining a plurality of holes for a mounting of the storage cabinet to a wall of a structure.

16. The storage cabinet of claim 1, further comprising a raised rim on the backside of the lid and defining a plurality of holes for a mounting of the storage cabinet to a wall of a structure.

17. The storage cabinet of claim 1, further comprising recessed handles disposed on one of the pair of walls and the tray and the lid.

18. A folding cabinet comprising:

a tray comprising a flat base, a raised rim having two lateral sides and an open front side;

a flat lid receiving for the tray and comprising two lateral sides, a middle between the two lateral sides having a back side and a front side;

a pair of walls hingedly cantilevered at the raised rim comprising a plurality of recessed sliding tracks extending toward the raised rim and configured to collapse like a drawbridge in the middle of the flat lid; and a slider arm sliding within one of the of recessed sliding tracks on a first end and hingedly attach to a lateral side of the flat lid on a second end.

19. The folding storage cabinet of claim 18, further comprising a spring release configured to latch the walls into an orthogonal position relative to the flat base.

20. A collapsible storage cabinet comprising:

a tray comprising a flat base having a raised rim on two lateral sides and an open front side;

a flat lid holding the tray with two lateral sides, a middle between the two lateral sides, and a back side and a front side;

a pair of cantilevered walls hingedly connected at the respective raised rim and comprising a plurality of recessed sliding tracks extending in a direction of the raised rim and collapsing like a drawbridge in the middle of the flat lid; and a slider arm sliding within one of the plurality of recessed sliding tracks on a first end and hingedly attached to a lateral side of the flat lid on a second end.

* * * * *